United States Patent [19]

Crawford et al.

[11] 4,218,785

[45] Aug. 26, 1980

[54] DRAIN ASSEMBLY FOR A LAVATORY BASIN

[75] Inventors: Dennis W. Crawford, Pontiac; Larry G. Turner, Waterford, both of Mich.

[73] Assignee: Bristol Products, Inc., Elkhart, Ind.

[21] Appl. No.: 30,118

[22] Filed: Apr. 16, 1979

[51] Int. Cl.[3] ..... E03C 1/22; A47K 1/14

[52] U.S. Cl. ..... 4/203; 4/295

[58] Field of Search ..... 4/191, 203, 295, 204, 4/201, 202, 287

[56] References Cited

U.S. PATENT DOCUMENTS

| | | | |
|---|---|---|---|
| 1,408,239 | 2/1922 | Allingham | 4/203 |
| 1,483,850 | 2/1924 | Kaufman | 4/203 |
| 1,485,669 | 3/1924 | Davis | 4/203 |
| 1,677,793 | 7/1928 | Mueller et al. | 4/203 |
| 1,758,226 | 5/1930 | Kaufman | 4/203 |
| 1,918,515 | 7/1933 | Beste | 4/203 |
| 2,657,398 | 11/1953 | Watkins | 4/203 |
| 2,689,959 | 9/1954 | Holycross, Jr., et al. | 4/203 |
| 3,419,919 | 1/1969 | Stayner | 4/203 |
| 3,453,667 | 7/1969 | Politz | 4/295 |
| 3,680,153 | 8/1972 | Haldopoulos et al. | 4/191 |
| 3,763,504 | 10/1973 | Parsons | 4/203 |

*Primary Examiner*—Henry K. Artis

*Attorney, Agent, or Firm*—Oltsch, Knoblock & Hall

[57] ABSTRACT

A drain assembly for a lavatory basin which includes a drain tube having a flanged upper end adapted for support by the basin. A drain plug is carried within the drain tube. A lift rod extends through the drain tube at a side opening therein and engages the plug. The lift rod is held in a sealed relationship against the tube by a retainer clamp which permits the lift rod to be shifted causing the drain plug to be correspondingly shifted between open and closed positions.

11 Claims, 10 Drawing Figures

10
12
14
16
18
20
40
42
44
46
48
50
52
54
62
64
66
68
70
72
74
76
78
80
82
84
86
88
94
96

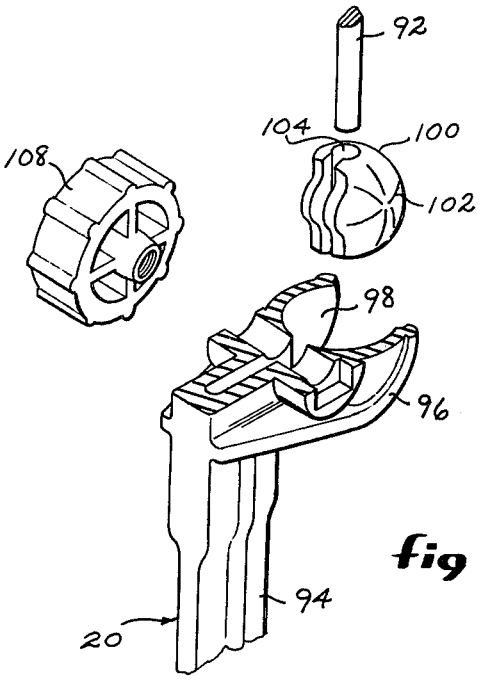
fig 6
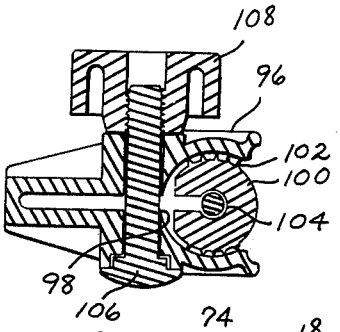
fig 7
fig 8
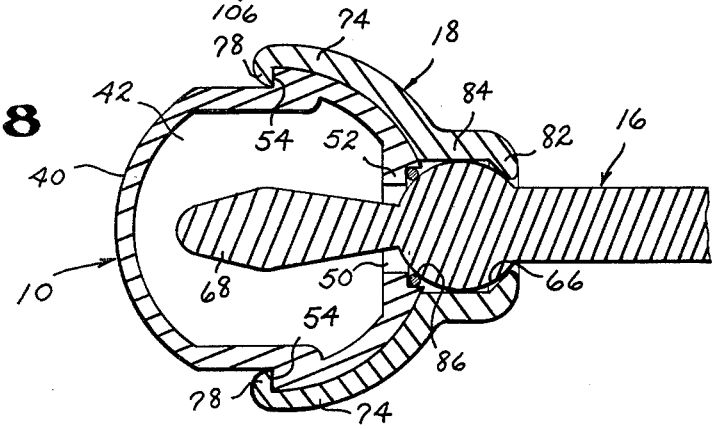

DRAIN ASSEMBLY FOR A LAVATORY BASIN

SUMMARY OF THE INVENTION

This invention relates to a drain assembly for a lavatory basin and will have specific applicability to a drain assembly which can be connected into a plumbing system in a simple and rapid manner.

In the drain assembly of this invention there is a drain tube which is suitable for connection to the lavatory basin and which extends downwardly from the basin for connection to a drain pipe which constitutes a part of the plumbing system of the home, office or other structure. A pop-up plug is fitted slidably within the drain tube and makes contact with a lift rod which extends into the drain tube below the basin through a side opening within the tube. The lift rod includes a rounded bearing section which seats against the drain tube side opening and is held there by a retainer clamp which engages the drain tube in a snap type fit. The lift rod is pivoted in a generally vertical plane about its rounded bearing section to raise and lower the plug between open and closed positions. Such movement of the lift rod is accomplished by an extension link to which the user of the lavatory basin has access and which includes an adjustable pivot which allows the extension link to be shifted in a vertical line while moving the lift rod in a non-binding, smooth operating effect.

The drain assembly is designed so as to minimize the amount of time and effort required to connect it to the lavatory basin and into the plumbing system for the basin. The preferred embodiment illustrated and about to be described may be entirely assembled by hand without the need of the usual forceful hand tools, such as wrenches and screwdrivers.

Accordingly, it is an object of this invention to provide a drain assembly which is for a lavatory basin and which is of economical construction.

It is another object of this invention to provide a drain assembly which is for a lavatory basin and which may be connected between the basin and the drain pipe of a plumbing system without the use of hand tools.

Still another object of this invention is to provide a drain assembly which is for a lavatory basin and which may be assembled in an easy and rapid manner.

And still another object of this invention is to provide a drain assembly which is for a lavatory basin and which is of reliable operation.

Other objects of this invention will become apparent upon a reading of the invention's description.

BRIEF DESCRIPTION OF THE DRAWINGS

A preferred embodiment of this invention has been chosen for purposes of illustration and description wherein:

FIG. 6 is a fragmentary view of the lockable pivot joint of the extension link shown in separated form with selected components thereof sectionalized for purposes of illustration.

FIG. 7 is a cross-sectional view of the extension link pivot joint.

FIG. 8 is a sectional view similar to that of FIG. 1 but showing the lift rod and retainer clamp in assembled form.

DESCRIPTION OF THE PREFERRED EMBODIMENT

The preferred embodiment illustrated is not intended to be exhaustive or to limit the invention to the precise form disclosed. It is chosen and described in order to best explain the principles of the invention and its application and practical use to thereby enable other skilled in the art to best utilize the invention.

Figures 1, 2, 3, 4, 4A:
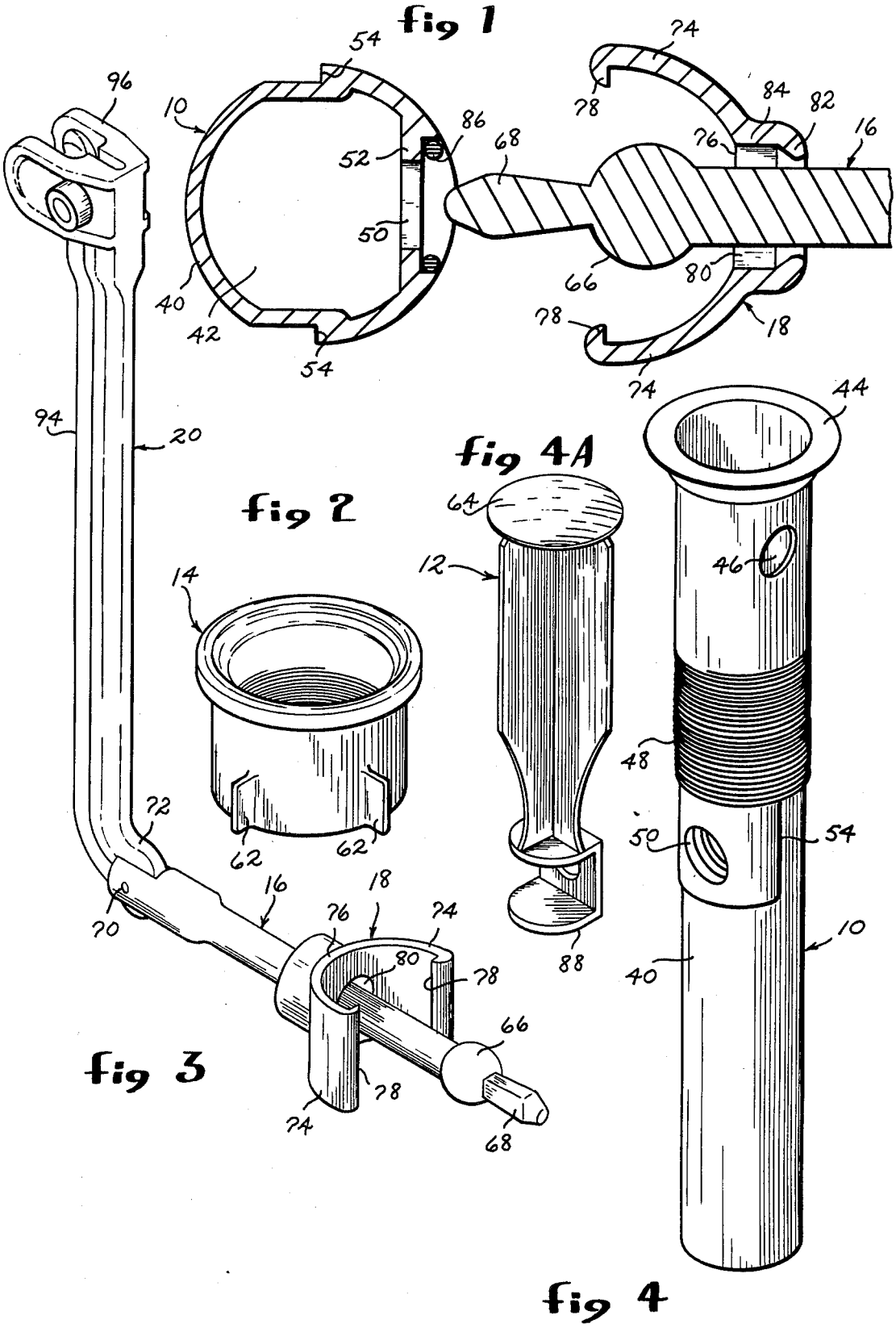
FIG. 1 is a sectional view of the drain tube, lift rod and retainer clamp utilized in the invention and shown in separated form.
FIG. 2 is a pictorial view of the retainer nut of the invention.
FIG. 3 is a perspective view of the extension link, lift rod and retainer clamp of the invention.
FIG. 4 is a perspective view of the drain tube.
FIG. 4A is a perspective view of the pop-up plug of the invention.
Figure 5:
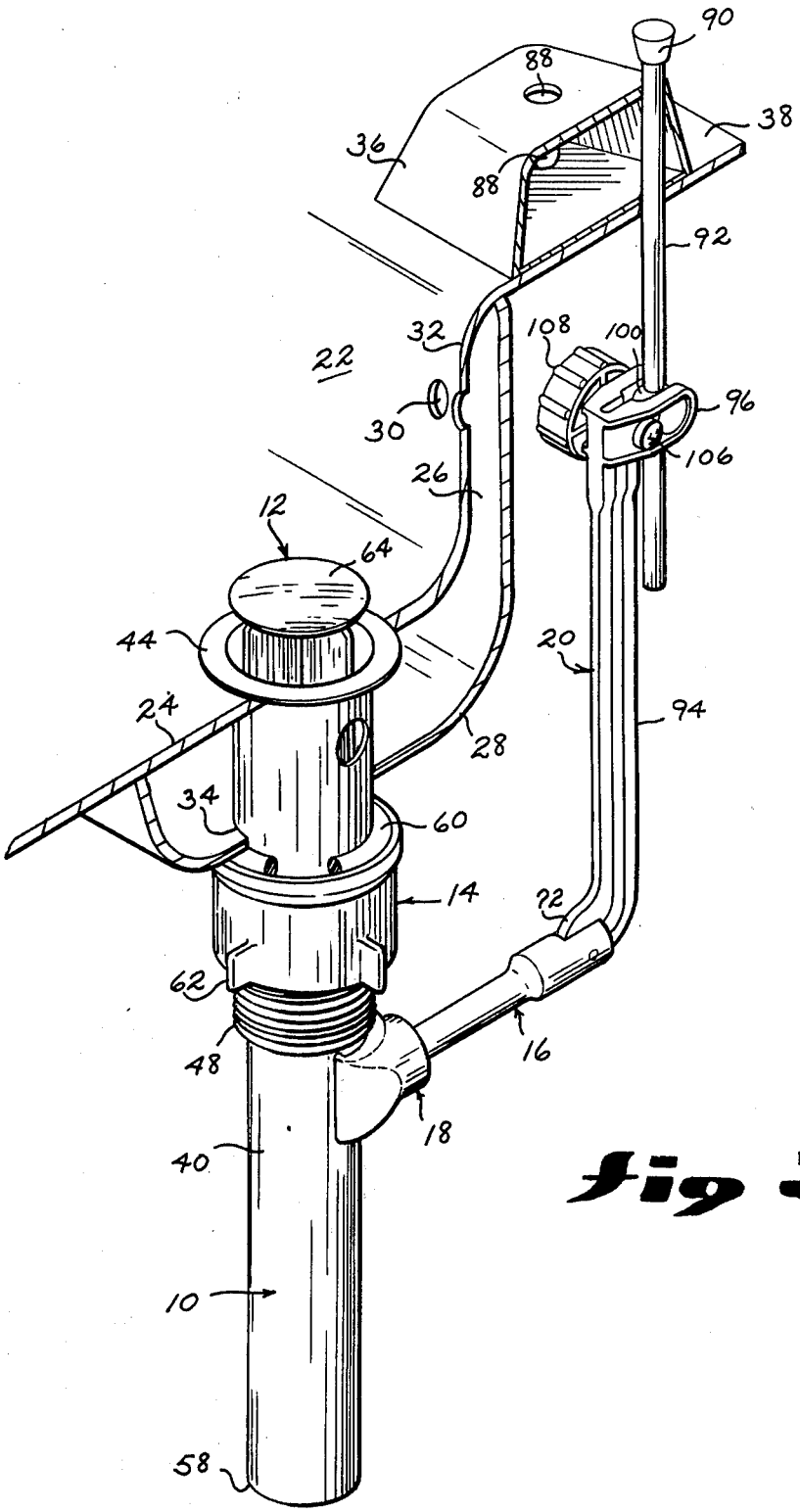
FIG. 5 is a perspective view showing the drain assembly in assembled form and connected to a lavatory basin shown sectionalized form for purposes of illustration.
Figure 9:
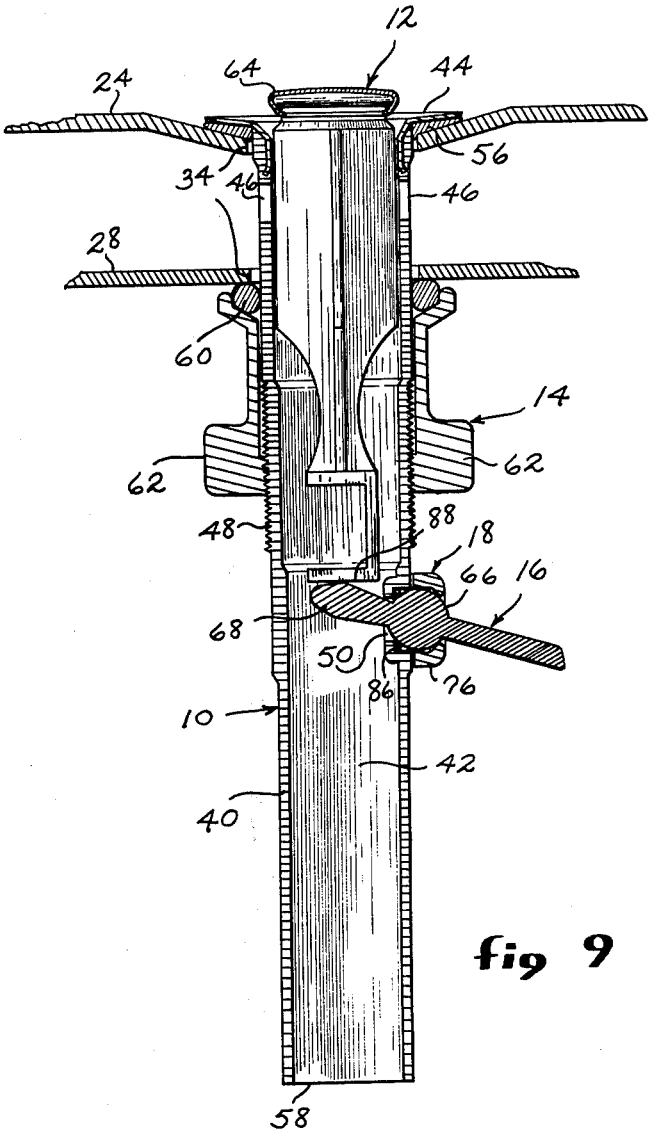
FIG. 9 is a sectional view in fragmentary form showing the drain assembly connected to a laboratory basin.

The drain assembly illustrated in FIGS. 1–9 include a drain tube 10, a pop-up plug 12, a retainer nut 14, a lift rod 16, a retainer clamp 18 and an extension link 20. The drain assembly is connected between a lavatory basin 22 and a drain pipe (not shown) of a building or household plumbing system.

Basin 22 includes a bottom wall 24 and an overflow drain 26 defined by a lower partition 28. Openings 30 are formed in side wall 32 of the basin at a predetermined height above bottom wall 24 to accommodate water or liquid overflow within the basin. A drain opening 34 is formed in bottom wall 24 and partition 28. A faucet cover plate 36 is carried by the upper rear flange 38 of basin 22. Cover plate 36 is normally utilized to house the valve components of the faucets (not shown) utilized with basin 22. The particular construction of the lavatory basin and its associated components such as the faucet assemblies and any cover plate can vary from basin to basin.

Drain tube 10 of the drain assembly includes a side wall 40 defining a liquid flow conduit 42 through the tube. Drain tube 10 includes a flanged seat 44 which is carried at its upper end. Drain overflow openings 46 are formed adjacently below seat 44. Drain tube 10 is also provided with external threads 48 which are located below overflow openings 46. A side opening 50, defined by a recessed annular shoulder 52, is formed in drain tube side wall 40 below threads 48. A pair of shoulders 54 are formed in the outer surface of drain tube side wall 40 at oppositely spaced generally diametrically located positions from side opening 50 in the tube.

Drain tube 10 as above described has a generally uniform transverse dimension which enables it to be inserted downwardly through drain opening 34 in basin 22 until seat 44 of the tube is supported by the bottom wall 24 of the basin. A flexible sealing ring 56 or sealing material such as putty is placed between seat 44 and basin bottom wall 24 about drain opening 34. Retainer nut 14 is placed over the lower end 58 of drain tube 10 and is turned onto threads 48 of the tube. Nut 14 carries a sealing O-ring 60 which is brought into sealing engagement with partition 28 of basin 22 about drain opening 34 as the nut is tightened. The tightening of nut 14 may be accomplished by the hand for which the nut is provided with grip tabs 62. The tightening rotation of nut 14 causes sealing rings 56 and 60 to be brought into compressive liquid sealing engagement with basin 22. Overflow openings 46 in drain tube 10 are positioned so as to be located between the bottom wall 24 and partition 28 of the basin. Threads 48 of drain tube 10 are spaced from the lower partition 28 of the basin to enable the drain tube to have a smooth cylindrical outer surface at the drain opening of the basin. This enables O-ring 60 to make secure sealing engagement with the drain tube about the basin drain opening without the need of supplemental putty of other type of sealing material.

Pop-up plug 12 fits slidably within conduit 42 of the drain tube. Plug 12 includes a flanged annular cap 64 which makes circumferential sealing engagement with seat 44 of the drain tube when the plug is located in its lowermost position within the drain tube. Plug 12 is shifted between its lower sealing position and a raised open position, shown in FIGS. 5 and 9, by lift rod 16. Rod 16 has one end portion formed into an enlarged spherical bearing surface 66 which terminates in a protrusion 68 coaxially positioned with respect to the rod. The opposite end of lift rod 16 is pivotally connected by a pin 70 to end 72 of extension link 20.

Retainer clamp 18 includes a pair of spaced arms 74 interconnected by a web part 76. Each arm 74 terminates in an inturned flange 78. Web part 76 of retainer clamp 18 has an opening 80 therein which is defined by an annular internal shoulder 82 and a cylindrical side wall 84. Arms 74 straddle retainer rod 16 with the rod extending through opening 80 in the clamp web part. Bearing surface 66 of lift rod 16 fits within opening 80 and against shoulder 82 of the clamp. With protrusion 68 of the lift rod extending into side opening 50 of drain tube 10, retainer clamp 18 is pressed against side wall 40 of the drain tube which causes arms 74 of the clamp to be slightly flexed and cammed about the side wall of the tube until flanges 78 of the clamp are snap-fitted around shoulders 54 of the tube, as seen in FIG. 8. An O-ring 86 is located at shoulder 52 of tube side opening 50. As retainer clamp 18 is interlocked with drain tube 10, bearing surface 66 of the rod is urged into sealing engagement with O-ring 86. In this position, lift rod 16 can pivot relative to drain tube 10 within retainer clamp 18 while a sealed relationship is maintained with the drain tube. Bottom 88 of pop-up plug 12 contacts protrusion 68 of lift rod 16 within flow conduit 42 of the tube. Shiftable up and down movement of lift rod 16 causes plug 12 to be correspondedly shifted between open and closed positions. In the manner just described, lift rod 16 can be connected to drain tube 10 after the tube is attached to a suitable lavatory basin, all without the need of hand tools.

Lift rod 16 is shifted by extension link 20 which is pivotally connected at its end 72 to the lift rod and which extends upwardly through openings 88 in basin 22 and cover plate 36 where its upper end 90 is accessible to the user of the basin. Extension link 20 is of a two piece construction, one piece being a rod 92 and the other piece being bar 94. Rod 92 and bar 94 are joined by an adjustable, lockable pivot connection. Bar 94 is formed at its opposite end from lift rod 16 into a yoke 96 defining a socket 98 having split halves. A ball member 100 fits within socket 98 and includes at its exterior surface a plurality of protrusions 102. A diametrical bore 104 is formed through ball member 100 with one side of the ball member being split to the bore to allow a reduction in transverse size of the bore upon a compressive force being applied in a transverse nature of the ball member when in socket 98. A screw 106 extends non-rotatably through yoke 96 with a tightening wheel 108 threaded onto the exposed end of the screw. Upon turning of wheel 108 upon screw 16, the two halves of yoke 96 are urged together causing ball member 100 to be compressed with its bore 104 being reduced in cross-section.

One end of rod 92 extends slidably through bore 104 in ball member 100 with tightening wheel 108 loosened upon screw 106. This allows rod 92 to be properly positioned with its upper end 90 selectively protruding from the top of basin 22 and its cover plate 36. Once rod 92 is vertically oriented and properly positioned within basin 22, wheel 108 is tightened upon screw 106 to cause the contraction of ball member 100 about the rod, thereby securing the rod to the ball member. As yoke 96 is tightened about ball member 100, the ball member is interlocked with the yoke so as to prevent pivotal movement of the ball member and its accommodating rod 92 relative to bar 94. Protrusions 102 of ball member 100 are pressed into interlocking engagement with the inner surface of yoke socket 98 to enhance the interlocking engagement between the ball member and yoke 96. In this manner, rod 92 can be oriented so as to shift in a parallel relationship relative to the axis of drain tube 10, thus providing for the smooth, non-binding up and down pivotal movement of lift rod 16.

Drain tube 10 except for perhaps its seat 44, pop-up plug 12 except perhaps for its cap 64, retainer nut 14, lift rod 16 and bar 94 of extension link 20 may be formed of a molded plastic composition. Ball member 100 forming the lockable pivot connection between rod 92 and bar 94 of extension link 20 is preferably formed of a material which is harder in composition than yoke 96 of bar 94 to facilitate the interlocking or biting engagement between ball member protrusions 102 and the inner surface of yoke socket 98. Although not shown, a suitable conduit, pipe or fitting will be connected to the lower end 58 of drain tube 10, serving to connect the drain tube into a plumbing drain system.

It is to be understood that the invention is not to be limited to the details above given but may be modified within the scope of the appended claims.

What we claim is:

1. In a drain assembly for a lavatory basin having a drain opening therein, said assembly including a drain tube having an upper end adapted to be supported by said basin with the tube extending through said drain opening, said drain tube including a side wall defining a liquid conduit extending from its said upper end lengthwise through the tube and having a side opening therein spaced from its said upper end in communication with the liquid conduit, a plug fitted into said liquid conduit at the upper end of said drain tube, a lift rod extending through said drain tube side opening and engaging said plug for lifting the plug out of liquid sealing engagement with the drain tube, an improvement wherein said drain tube includes an abutment part defining at least in part said side opening therein, said lift rod including a rounded bearing section, said drain tube including engagement parts, a retainer clamp contacting said rod bearing section and including means interlocking with said drain tube engagement parts for urging the bearing section pivotally against said drain tube abutment part.

2. The drain assembly of claim 1 wherein the outer transverse dimension of said drain tube at its said side opening is less than the outer transverse dimension of said drain tube upper end.

3. The drain assembly of claim 2 wherein said drain tube includes external threads formed below its said upper end, retainer nut means for turning upon said drain tube threads to clamp said basin between said drain tube upper end and said nut means, the outer transverse dimension of said threads being at least equal to the outer transverse dimension of said drain tube at its side opening.

4. The drain assembly of claim 1 wherein said retainer clamp interlocking means forms a snap fit with said drain tube engagement parts.

5. The drain assembly of claim 4 wherein said drain tube engagement parts are shoulders located on opposite sides of said drain tube side opening, said retainer clamp interconnecting means including spaced arm parts straddling said rod bearing section and fitting restrictively about said shoulders.

6. The drain assembly of claim 5 wherein said retainer clamp includes a web joining said arm parts, said web having an opening therein, said lift rod extending through said web opening.

7. The drain assembly of claim 1 wherein said drain tube abutment part includes an annular shoulder supporting an O-ring, said rod bearing section contacting said O-ring.

8. The drain assembly of claim 1 and an extension link having one end pivotally connected to said lift rod and its opposite end adapted for gripping by a basin user to open and close said plug, said extension link being of a two piece construction joined intermediate its ends by a lockable pivot connection, one piece of said extension link including a rod, the other piece of said extension link including a bar, said bar terminating in a socket part having split halves, a ball member having a bore therethrough and including means wherein the bore is reduced in transverse dimension upon compression of the ball member, said link rod extending adjustably through said ball member bore, said ball member fitting adjustably in said bar socket part, and means for compressing said socket part halves about said ball member wherein said ball member is restrictively clamped and said bore thereof is reduced in transverse dimension to clamp said link rod, whereby a rigid joint is formed at said link pivot connection.

9. The drain assembly of claim 8 wherein said ball member includes surface projection means for penetrating said socket part halves upon compression of the halves about the ball member, whereby the restrictive clamp of the socket part about the ball member is enhanced.

10. In a drain assembly for a lavatory basin having a drain opening therein, said assembly including a drain tube having an upper end adapted to be supported by said basin with the tube extending through said drain opening, said drain tube including a side wall defining a liquid conduit extending from its said upper end lengthwise through the tube and having a side opening therein in communication with the liquid conduit, a plug fitted into said liquid conduit at the upper end of said drain tube, a lift rod extending through said drain tube side opening and engaging said plug for lifting the plug out of liquid sealing engagement with the drain tube, an extension link having one end pivotally connected to said lift rod and its opposite end adapted for gripping by a basin user to open and close said plug upon shiftable movement of the lift rod, the improvement wherein said extension link is of a two piece construction joined intermediate its ends by a lockable pivot connection, one piece of said extension link including a rod, the other piece of said extension link including a bar, said bar terminating in a socket part having split halves, a ball member having a bore therethrough and including means wherein said bore is reduced in transverse dimension upon compression of the ball member, said link rod extending adjustably through said ball member bore, said ball member fitting adjustably in said bar socket part, and means for compressing said socket part halves about said ball member wherein said ball member is restrictively clamped and said bore thereof is reduced in transverse dimension to clamp said link rod, whereby a rigid joint is formed at said link pivot connection.

11. The drain assembly of claim 10, wherein said ball member includes surface projection means for penetrating said socket part halves upon compression of the halves about the ball member, whereby the restrictive clamp of the socket part about the ball member is enhanced.

* * * * *